United States Patent [19]

Jung

[11] 4,082,021

[45] Apr. 4, 1978

[54] HORIZONTAL SPLITTING APPARATUS

[75] Inventor: Rolf Jung, Waiblingen, Germany

[73] Assignee: Krauss u. Reichert, Spezialmaschinenfabrik GmbH & Co., Fellbach, Germany

[21] Appl. No.: 727,439

[22] Filed: Sep. 28, 1976

[30] Foreign Application Priority Data

Oct. 2, 1975 Germany ..... 2543990

[51] Int. Cl.[2] ..... B26D 1/46; B26D 4/00

[52] U.S. Cl. ..... 83/4

[58] Field of Search ..... 83/4, 803, 813, 814, 83/816, 804, 808, 820

[56] References Cited

U.S. PATENT DOCUMENTS

| | | | |
|---|---|---|---|
| 2,700,402 | 1/1955 | Walden | 83/816 X |
| 2,807,921 | 10/1957 | Dewing et al. | 83/4 X |
| 3,850,061 | 11/1974 | Wirstrom | 83/813 X |

FOREIGN PATENT DOCUMENTS

| | | | |
|---|---|---|---|
| 2,063,427 | 4/1972 | Germany | 83/4 |

*Primary Examiner*—Willie G. Abercrombie
*Attorney, Agent, or Firm*—Bernard & Brown

[57] ABSTRACT

A machine utilizing an endless band knife mounted so as to define two horizontally spaced cutting edges, both said edges facing in the same direction. A work piece support and the band knife have to and fro relative movement. The cutting edges are mounted for vertical adjustment relative to the workpiece support.

12 Claims, 3 Drawing Figures

HORIZONTAL SPLITTING APPARATUS

The present invention relates to a horizontal splitting apparatus for splitting blocks of foamed plastics material and similar materials into layers.

The conventional horizontal splitting apparatuses on the market comprise a work piece table adapted to be reciprocated in a longitudinal direction and having columns mounted on both sides of the table for guiding a vertically adjustable cutting unit. The latter comprises a rotating band knife forming an endless loop, said loop being disposed in a substantially vertical plane and forming a lower flight of the band knife extending in a substantially horizontal direction, said flight extending in a knife sheath and serving to split the blocks of foamed plastics material. In order to split the blocks of foamed plastic material in successive layers, the blocks are moved together with the work piece table towards the cutting flight of the band knife, and after a layer has been cut from each of the blocks the work piece table is reset by moving it in the opposite direction thereby moving the lower flight of the band knife and its sheath between the layer just separated and the remaining block material. Then the cutting unit is lowered a distance corresponding to the thickness of the next layer of material to be separated from the remaining blocks. A horizontal splitting apparatus of this type is often found as a component of a cutting conveyor line in which long blocks of foamed plastics material are first of all split into horizontal layers or plates in the aforementioned manner and a crosscut or vertical cutting machine adjoining the horizontal splitting apparatus along the cutting conveyor line then serves the purpose of cutting these long plates or layers to length in a transverse direction. A typical example of a cutting conveyor line of this kind is one for the manufacture of mattresses of foamed plastics material, where the width of the blocks of foamed plastics material to be worked on by the horizontal splitting apparatus corresponds to the length of the mattresses of foamed plastics material.

In practice, it is found to be a disadvantage that for the aforementioned known horizontal splitting apparatuses a space is required whose length corresponds to twice the length of the blocks of foamed plastics material with which the horizontal splitting apparatus is supplied—at the beginning of each cutting cycle the entire block of foamed plastics material to be worked on is located in front of the cutting unit, whilst after termination of the cutting procedure it is disposed in its entire length behind the cutting unit. Furthermore, since the cutting procedure cannot be effected at optionally high feed rates the cutting efficiency of the known above described horizontal splitting apparatus is limited.

In order to eliminate the last-mentioned disadvantage horizontal splitting apparatuses have also been developed wherein the endless loop formed by a band knife comprises two cutting flights (German laid open patent application No. 2,347,436 and British patent specification No. 1,379,359). In this known horizontal splitting apparatus on both sides of a reciprocable work piece table columns are mounted along which arms adapted to be shifted in a vertical direction are guided in a vertically adjustable manner. These arms carry guide rollers with a vertical axis for the band knife. The latter is turned through 90° respectively at the ends of both flights extending over the work piece table, in such a way that the sharpened cutting edges of both of these flights face in opposed directions. One single knife sheath having two guiding slits opened in these two directions serves to guide the two cutting flights. With a horizontal splitting apparatus of this type cutting can in theory be effected during both the forward and return motion of the work piece table or the block of foamed plastics material—inbetween the cutting unit has to be lowered accordingly—however, practice has shown that with such horizontal splitting apparatuses very thin layers or foils of foam plastic and the like cannot be manufactured at all and thicker layers only at a substantially lower speed than with machines cutting in only one direction (for example only at 25 m/min instead of 80 m/min): from the cutting pressures and frictional forces being effective in different directions during the reciprocating motion layers with wedge shaped cross sections result.

The aim of the present invention was to produce a horizontal splitting apparatus which cuts with the same precision as the first-mentioned conventional horizontal splitting apparatus but which has a higher cutting efficiency and requires less space than this known apparatus. Departing from a horizontal splitting apparatus of the second known type, i.e., a horizontal splitting apparatus with a work piece support and two substantially horizontally extending cutting flights of at least one cutting member forming an endless loop, wherein the work piece support and cutting member are slideable to and fro relative to one another and the cutting flights extending over the work piece support in a substantially transverse direction in relation to the sliding direction are spaced from one another in the sliding direction and are vertically adjustable, this aim is achieved according to the invention in that the cutting areas (cutting edges) of the two cutting flights face in the same direction, which can be readily achieved by twisting the cutting member accordingly at the ends of the two flights. If a horizontal splitting apparatus according to the invention is supplied with work pieces or blocks of foamed plastics material which are not longer than the horizontal distance of the two cutting flights from one another, then the two flights can always operate simultaneously.

Supplying the horizontal splitting apparatus according to the invention with several shorter blocks of foamed plastics material, however, is not disadvantageous (compared with the above firstly described prior art), because 95% of all parts manufactured by using horizontal splitting apparatuses comprise a maximum edge length of appr. 2 m. In comparison to these known horizontal splitting apparatuses of the first type the horizontal splitting apparatus according to the invention has the advantages that only 75% of the space of these machines is required in the sliding direction of the work pieces, secondly that the cutting efficiency is twice as great and furthermore a substantially lower structural height (appr. 1 m less) is necessary: if a known horizontal splitting apparatus of the first type is to be capable of working on work pieces up to a predetermined maximum height, owing to the upright band knife loop the maximum structural height of this known apparatus above the level of the work piece support is more than twice as great as the maximum height of the work pieces, whilst the structural height of a horizontal splitting apparatus according to the invention above the level of the work piece support does not need to be much greater than the maximum height of the work piece. In comparison to the known horizontal splitting apparatus of the second type (German laid open patent application No. 2,347,436 or British patent specification No. 1,379,359), the construction according to the invention does not only have the advantage that it cuts more precisely but also—provided the cutting speeds are the same—with the same cutting efficiency required, the structural length is 25% smaller.

It would be possible to carry out the basic principle of the invention using a stationary work piece support and reciprocating cutting members; however, it is more appropriate to mount the cutting members in a stationary manner—apart from the vertical adjustability—and provide a reciprocating work piece support.

The two cutting flights could of course—without the advantage of the decrease in structural height—be formed from two cutting member loops disposed in substantially vertical planes—in comparison to two known horizontal splitting apparatuses of the first type disposed behind one another one would save on drive and control means for the second work piece support. However, it is more appropriate if (as disclosed in German laid open patent application 2,347,436) both cutting flights are formed by a single band knife forming a horizontal loop, said band knife being twisted through substantially 90° respectively at the ends of the two flights.

In a preferred embodiment of the invention a knife sheath clamped between two lateral traverse members of a cutting unit is associated with each of the two flights and both knife sheaths are open in the same direction. Thus the only additional expenditure as compared with a known horizontal splitting apparatus of the first described type is that of the second knife sheath.

In the known described horizontal splitting apparatuses the vertical adjustment of the cutting unit is effected by means of a shaft extending beneath the work piece support and two threaded spindles, chains or the like, extending in the lateral supports or columns and being driven by bevel or worm gear drive means from the transversely extending shaft. Another feature of the invention is that in a horizontal splitting apparatus having a portal extending over the work piece support and comprising two lateral columns and a cross beam and at whose columns the cutting unit is held in a vertically adjustable manner, the constructional expenditure for the vertical adjustment is decreased in that the cutting unit is suspended at both sides of the portal on at least one rope, belt or the like, the rope of one side being deviated through 180°, and in that at the portal, preferably on its cross beam, fastening means for the ropes are slideably guided in the longitudinal direction of the ropes and are adjustable by means of a motor. This fastening means can be displaced, for example, by means of a threaded spindle, and so in comparison to the known construction, a threaded spindle or chain drive and a bevel or worm gear drive means can be saved on.

Further features, advantages and details of the invention can be taken from the enclosed claims and/or the following description and the enclosed drawings of a preferred embodiment of a horizontal splitting apparatus according to the present invention.

Figure 1:
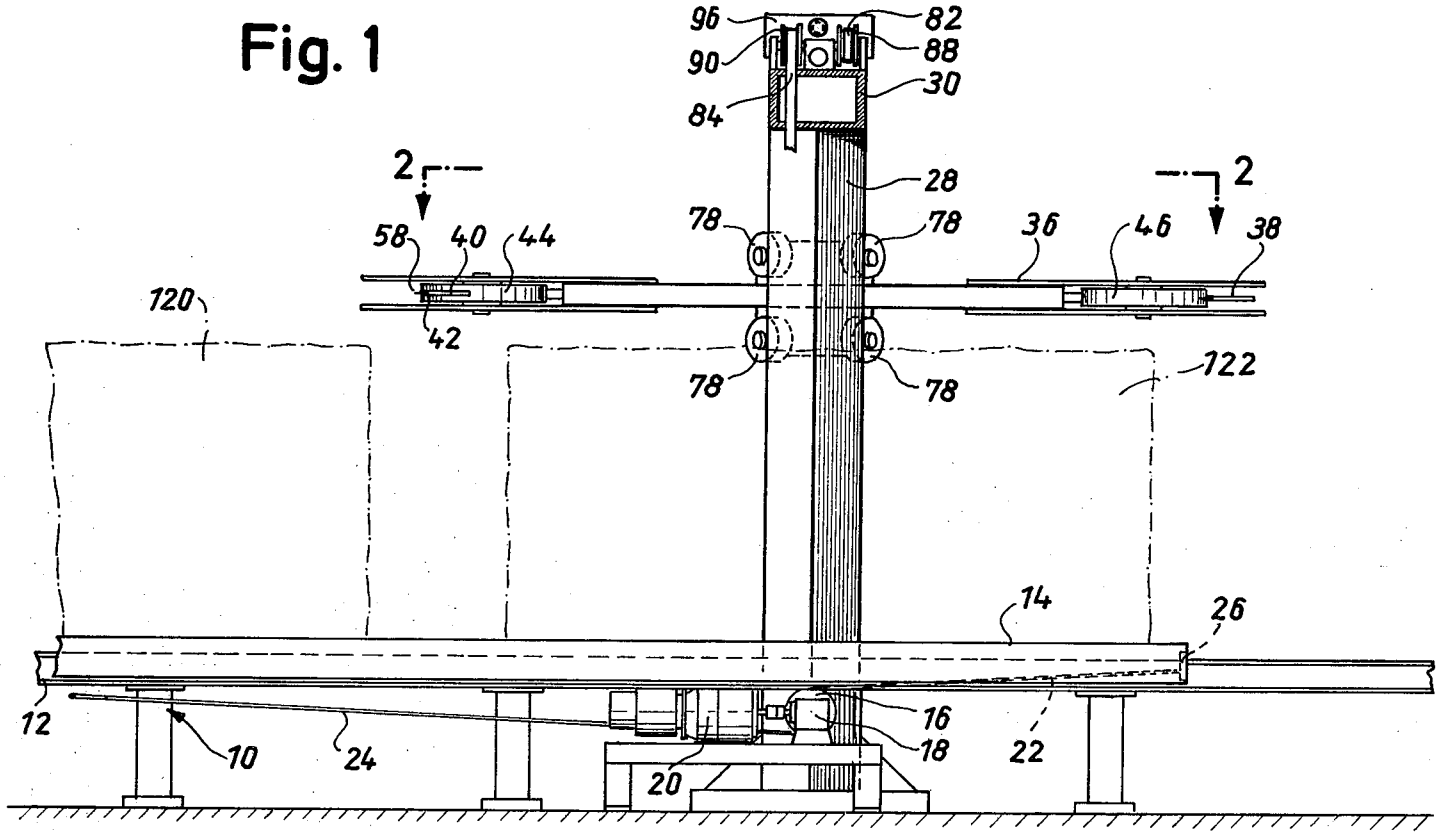
FIG. 1 is a longitudinal cross section of the apparatus in a vertical plane according to line 1—1 in FIG. 2.
Figure 2:
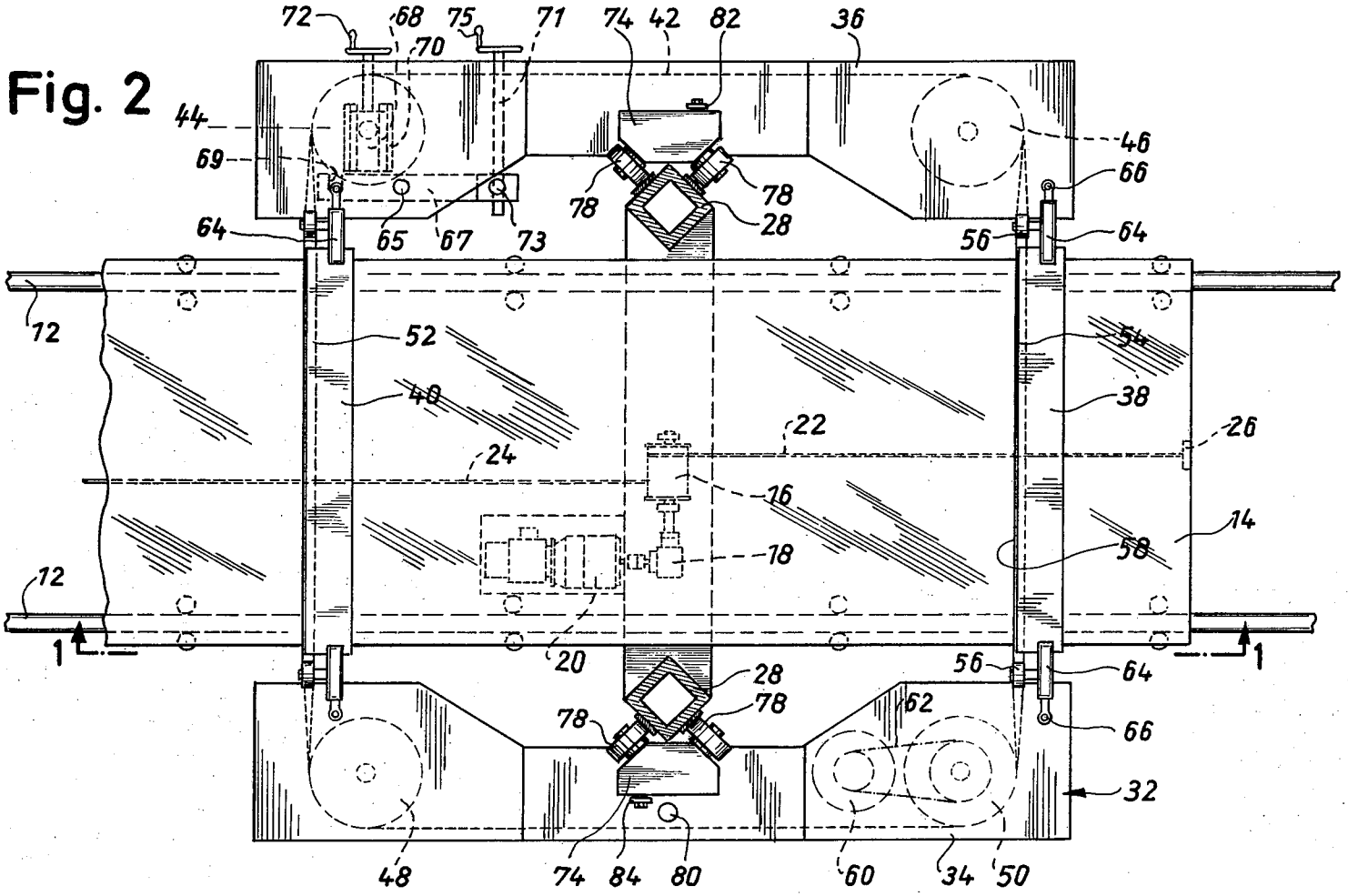
FIG. 2 is a plan view of the apparatus, partly sectional, according to line 2—2 in FIG. 1.

As can be seen from FIGS. 1 and 2, the apparatus comprises a frame 10 with rails 12 on which a work piece table 14 as shown in FIG. 1 can be transported from left to right and back. A rope drum 16 serves as drive means for the table, said rope drum being driven by a reversable electric motor 20 and a miter gear 18. Two ropes 22 and 24 are wound onto this rope drum in opposed directions—it could also be one single rope, secured at its center to the drum—the other ends of said ropes be secured at the front edges of the work piece table 14 at 26 (FIGS. 1 and 2 show only one of the two securing positions, because these figures show only part of the work piece table 14.

On each of both sides of the frame 10 a column 28 is disposed and the two columns are connected by means of a cross beam 30, extending over the work piece table. They serve to guide a cutting unit designated as an entire unit by 32 and comprising essentially two lateral traverse members 34 and 36 and two knife sheaths 38 and 40. Together these form a square or rectangular frame in which an endless band knife 42 forming a loop circulates. For this purpose disc wheels 44 to 50 having upright axes are mounted in the traverse members, said band knife being guided by means of said disc wheels and contacting the disc wheels with one of its main surfaces. The two flights 52 and 54 of the band knife extending between the traverse members 34 and 36 are, however, disposed in a horizontal plane, since the band knife is twisted through 90° respectively at the ends of these flights by means of pairs of wheels 56, in such a way that in the region of the two knife sheaths 38 and 40 a sharpened cutting edge 58 of the band knife points towards the left (according to FIGS. 1 and 2).

Accordingly, the knife sheaths comprise guiding slits opened towards the left in which the band knife extends.

An electric motor 60 mounted at the traverse member 34 serves as drive means for the band knife and drives the disc wheel 50 by means of a belt drive means 62. The disc wheel 44 is mounted in a block 68 which is slideable in a guide means 70 and can be pulled in an outward direction (in FIG. 2 in an upward direction) by means of a crank 72; the band knife 42 can thereby be tightened or stretched. The knife sheaths 38 and 40 are mounted, i.e., hinged at the traverse means 34 and 36 by means of lashings 64 which are attached to transverse members 34 and 36 at bearings 66.

The traverse members 34 and 36 are disposed between blocks 74 at which four rollers 78 per traverse member are mounted, in such a way that they run on the surfaces of the columns 28 facing in an outward direction. So that the two knife sheaths 38 and 40 can be tightened by means of tightening one of the knife sheaths, one of the traverse members, for example traverse member 34, is pivotable about a vertical axis between its associated blocks 74; this axis is designated by 80 in FIG. 2.

Furthermore it can be seen from FIG. 2 a two-armed lever 67 pivotable about a vertical axis 65 is hinged to the left end of the traverse member 36, one end of said lever holding the one bearing of one of the lashings 64 of the knife sheath 40 in a slit 69, whilst a nut 73 running on a spindle 71 is mounted at the other end of said lever. This spindle is rotatable, but is held in the traverse member 36 in an axially non-slideable state and is provided with a hand wheel 75, so that by pivoting the lever 67—owing to the link mounting of the traverse member 34 and the link connection between traverse members 34,36 and knife sheaths 38,40—both knife sheaths can be tightened simultaneously by means of the lashings 64.

When the knife sheaths are tightened, the traverse members 34, 36 are forced towards the columns 28 and owing to the pairs of rollers 78 being disposed above one another the cutting unit 32 is thus held in a horizontal position.

Figure 3:
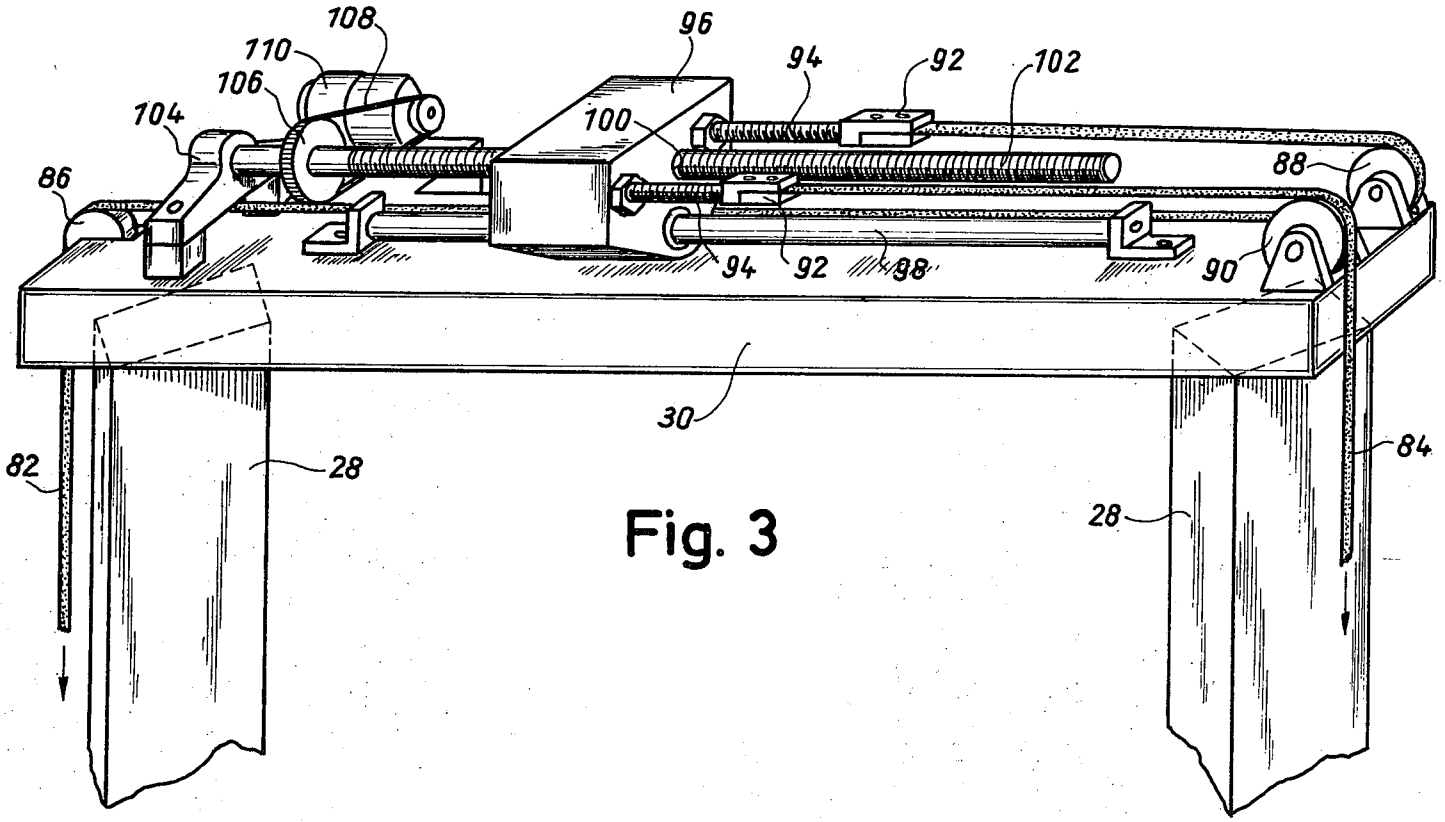
FIG. 3 is a perspective illustration of the upper part of the portal of the apparatus.

As depicted in FIG. 3, drawstrings 82 and 84 secured at the upper blocks 74 and extending in an upward direction to the cross beam 30 serve to suspend the cutting unit. The drawstring 82 passes over a first deviating roller 86, which deviates it through 90°, and then over a deviating roller 88, which deviates it through 180°, whilst the drawstring 84 passes over only one deviating roller 90 by means of which it is deviated through 90°. The other ends of the drawstrings are secured between sets of claws 92, which are adjustably supported by a block 96 by means of threaded rods 94. This block 96 is slideably guided on a guide rod 98, secured to the cross beam 30, and comprises a threaded bore 100, through which a threaded spindle 102 passes. This threaded spindle supported by a bearing 104 is provided with a disc 106 for a teeth belt 108 which can be driven by an electric motor 110. It is thus possible to adjust the cutting unit 32 vertically.

To insure that the cutting unit 32 is also held in a horizontal position before tightening of the knife sheaths 32, 34, the traverse members 34 and 36 are so designed, or rather the drawstrings 82 and 84 are secured thereto in such a way, that relative to the mounting positions such a tilting moment is always present as to make the eight rollers 78 abut the columns 82.

FIG. 1 shows two blocks of foamed plastics material 120 and 122, whose length is smaller than the distance between the cutting flights 52 and 54 of the band knife. By lowering the cutting unit 32 step by step and displacing the work piece table 14 as shown in FIG. 1 and 2 from the left to the right it is possible to split the two blocks of foamed plastics material simultaneously in a horizontal direction during each displacement. After each cut has been effected the work piece table 14 is returned again to the left so that the knife sheaths and the cutting flights of the band knife slide back through the blocks of foamed plastics material in the plane in which the cut has just been effected, whereupon the cutting unit 32 is lowered through a distance corresponding to the thickness of the desired foam plastic layers.

Since both cutting flights can only be used simultaneously if the blocks of foamed plastics material are not longer than the distance between the two cutting flights 52 and 54, it is sufficient if the path of displacement of the work piece table corresponds to this distance. Furthermore, the length of the latter must be only slightly greater than twice the distance between the two cutting flights 52 and 54.

I claim:

1. Horizontal splitting apparatus comprising a work piece support, two cutting flights each having a cutting means and both being provided by at least one cutting member forming an endless loop, and drive means for displacing the work piece support and the cutting flights to and fro relative to one another, said cutting flights extending over the work piece support in a substantially horizontal and transverse direction in relation to the direction of displacement, said cutting flights being spaced from one another in the direction of displacement and having their cutting means facing in the same direction, and means for vertically displacing said cutting flights relative to said work piece support.

2. Horizontal splitting apparatus as set forth in claim 1, characterized in that the two cutting flights are formed by one single band knife forming a horizontal loop, and by means for twisting said band knife at the ends of the two flights through substantially 90° respectively.

3. Horizontal splitting apparatus as set forth in claim 1, characterized in that the path of displacement between the work piece support and the cutting member is at the most equal to the distance between the two cutting flights.

4. Horizontal splitting apparatus as set forth in claim 1, characterized in that the length of the work piece support is only slightly greater than twice the distance between the two cutting flights.

5. Horizontal splitting apparatus as set forth in claim 2, characterized in that a knife sheath stretched between two lateral traverse members of a cutting unit is associated with each of the two flights and in that both knife sheaths are open in the same direction.

6. Horizontal splitting apparatus as set forth in claim 5, comprising two lateral columns at which the cutting unit is guided in a vertically adjustable manner, characterized in that the traverse members are guided in a non-tiltable manner at the columns, and in that at least one stretching device is provided to stretch the two knife sheaths, so that the cutting unit is held in a horizontal plane.

7. Horizontal splitting apparatus as set forth in claim 5, comprising a portal extending over the work piece support and consisting of the lateral columns and a cross beam, characterized in that the cutting unit is suspended at both sides of the portal on at least one flexible support means, in that the support mean of one side is deflected through 180° and in that at the portal, fastening means are provided for the support means which are displaceable in the longitudinal direction of the support means and adjustable by means of a motor.

8. Horizontal splitting apparatus as set forth in claim 7, characterized in that the fastening means are provided on the cross beam of the portal.

9. Horizontal splitting apparatus as set forth in claim 5, characterized in that the two knife sheaths are hinged to the traverse members.

10. Horizontal splitting apparatus as set forth in claim 2, characterized in that the path of displacement between the work piece support and the cutting member is at the most equal to the distance between the two cutting flights.

11. Horizontal splitting apparatus as set forth in claim 2, characterized in that the length of the work piece support is only slightly greater than twice the distance between the two cutting flights.

12. Horizontal splitting apparatus as set forth in claim 3, characterized in that the length of the work piece support is only slightly greater than twice the distance between the two cutting flights.

* * * * *